US005907544A

United States Patent [19]

Rypinski

[11] Patent Number: 5,907,544

[45] **Date of Patent: *May 25, 1999**

[54] HUB CONTROLLER ARCHITECTURE AND FUNCTION FOR A MULTIPLE ACCESS-POINT WIRELESS COMMUNICATION NETWORK

[76] Inventor: Chandos A. Rypinski, 655 Redwood Hwy. #340, Mill Valley, Calif. 94941

[ * ] Notice: This patent is subject to a terminal disclaimer.

[21] Appl. No.: 08/644,409

[22] Filed: May 10, 1996

[51] Int. Cl.[6] ..... H04H 1/00

[52] U.S. Cl. ..... 370/337; 370/342; 370/344; 370/347; 455/517

[58] Field of Search ..... 370/346, 352, 370/329, 349, 337, 335, 342, 344, 347; 375/200, 202; 455/517, 518, 519

[56] References Cited

U.S. PATENT DOCUMENTS 5,414,731 5/1995 Antunes et al. ..... 375/202
5,436,905 7/1995 Li et al. ..... 455/517
5,461,627 10/1995 Rypinski ..... 370/346
5,570,367 10/1996 Ayanoglu et al. ..... 370/346
5,630,061 5/1997 Richter et al. ..... 370/352

*Primary Examiner*—Hassan Kizou
*Assistant Examiner*—Shick Hom
*Attorney, Agent, or Firm*—Larry D. Johnson

[57] ABSTRACT

A method for controlling a common channel wireless access premises area communication network, providing setup and low-delay transfer of either or both packet data or virtual connections by a limited length segmental packet transmission. The system includes a plurality of access points and a hub controller connected to and sequentially controlling the access points, providing wireless communication services from the access points to a plurality of stations.

14 Claims, 6 Drawing Sheets

HUB CONTROLLER ARCHITECTURE AND FUNCTION FOR A MULTIPLE ACCESS-POINT WIRELESS COMMUNICATION NETWORK

BACKGROUND OF THE INVENTION

1. Field of the Invention

The invention is an infrastructure function needed in large scale wireless local or premises area networks where the user Stations are or may include battery-powered portable computers and pocket telephones either fixed or moving. The service function is setup and low-delay transfer of either or both packet data or virtual connections by means of limited length segmental packet transmission. The system architecture providing these functions is the subject invention. Microwave radio frequencies are assumed to be the primary transmission means, however optical propagation is also a usable medium.

2. Description of Prior Art

If many common channel wireless Access-points are placed sufficiently close together to obtain near continuous coverage over a wide area, then the communication between one Station and the nearest Access-point may be subject to interference from simultaneous activity at other nearby Access-points.

The commonplace and trivial solution is to reduce the total traffic carried in the system to a point where collisions are improbable, and then to provide a recovery mechanism when they do occur. This is the philosophy when an effort is made to adapt the IEEE 802.3 CSMA/CD access method to wireless (as discussed in Rypinski U.S. Pat. No. 5,461,627).

This difficulty can be resolved by using Access-points sequentially, rather than simultaneously, within a group pattern. There remains the obvious problem of common control and routing, and two non-obvious problems:

1) making movement of Stations between Access-point coverages invisible to external interconnected networks, and
2) making the speed of adaptation to changed access path less than the smallest inter-message time spacing possibly only a few milliseconds.

Bridge-per-Access-point Architecture

Within the IEEE 802.11 Standards Committee and in other forums for wireless local area networks, it has been suggested that each wireless Access-point be a tap on a common backbone local area network (LAN). The backbone LAN, for example, might be: IEEE 802.3 CSMA/CD (Carrier-Sensing Multiple Access/Collision Detecting). This LAN in one version uses "daisy-chained" coaxial cable and in another version telephone pairs as the connecting physical medium, where these pairs are installed between each Station and a common hub unit.

Each tap on a backbone LAN is a bridge or router to an interconnected network depending on the protocol level at which the interconnection is made. Bridges have "filters" so that the bridge does not pass messages between networks which are local in either network alone. Routers have the capacity to direct an incoming message on one network to another bridge on another network or to select between a plurality of connected networks for forwarding. A gateway may do all of these things, but is used where the connected networks are of different types.

Inter-network Routing

To facilitate routing, automatic functions have been defined. The first of these is called "spanning tree" using an algorithm defined in IEEE Local Area Network Standard 802.1D "Media Access Control (MAC) Bridges." Only a few points in this complex area must now be understood.

The bridge depends upon tables identifying the network with which various addresses are associated. If the network is reached from a particular bridge through intermediate bridges, then only the next relaying bridge is known. All of this information is "learned" when the bridge listens to its ports, and when it is asked to relay a message to a new destination. In this process, exploratory messages may be generated to determine routing to a new address.

An event occurs when a new Station appears (or disappears) or when a Station addresses another which is not presently known on a connected network. Such events may cause many exploratory messages and responses to update bridge filtering and routing tables.

If each Access-point is bridged into a common backbone LAN, such events will occur whenever a Station changes from the coverage of one to another Access-point. This may occur from a movement of a few feet or from passing obstacles like walking persons. The smaller the coverage of each Access-point, the greater the frequency of coverage changes for comparably moving Stations.

The philosophy of bridging in LAN is that each Station is normally on one network and infrequently (in terms of radio fading) moves to another. The reconfiguring messages take time, though not much by human reference. Many continuing moves by many Stations create the possibility of overloading the backbone network with learning tasks.

Efficiency

A bridging between an 802.11 and an outside LAN may have much more function to support routing than does bridging between two 802.11 LAN access points since the same function in the Hub Controller is common equipment. A further consideration with bridge-per-Access-point configurations is that within a sequential group only one transmitter at a time is used. There is no way to avoid provisioning of transmit medium access control and other functions at all Access-points.

Selection Diversity

Prior art in more conventional radio systems uses duplicate receiving systems each connected to an antenna separated from the others but all at a common site. If the received signal is continuous, a switch is used to select the output of the receiver with the best signal. If the signal is bursty, then the selection decision is made within a very short interval after the signal appears. More refined versions would base the selection on signal-to-noise ratio rather than signal level.

This prior art is used for voice communication, and is not very relevant to data burst transmission. Diversity systems which sum the signals from several antennas before or during demodulation are entirely irrelevant to this problem. Finally, multiple antennas at one site is not the same problem as selecting between signals from one of several sites.

Coordination of Activity Among Large Numbers of Base Stations

Many prior art systems are frequency-division channelized; and some provide time-division sub-channels to increase the communication capacity at one base station. "Cellular" mobile telephone is based on a "reuse" group size. Systems are planned on the basis that 7, 9, 12 or more channel groups are available for simultaneous use when contiguously located. The limits are determined by the geographic spacing necessary for independent operation of the same channel at different places consistent with continuous coverage on one or another channel at nearly all places.

Considering "reuse" factor, the coordination between reuse groups is not known to have been addressed in any other context but cellular wireless telephony or its proposed successors. Even there, the considerations in a channelized system are quite different than for time separation.

SUMMARY OF THE INVENTION

The hub controller architecture and function for a multiple access-point wireless communication network of this invention depends upon the access-method and the air interface for the "ACCESS PROTOCOL FOR A COMMON CHANNEL WIRELESS NETWORK" described in Rypinski U.S. Pat. No. 5,461,627. Communication is accomplished with limited length data bursts identified for processing at the receiving point by information in a header.

The invention provides:

1) the means of dealing with Stations that move between Access-points during the potentially small (milliseconds) time interval between consecutive segments or messages;
2) the architecture of a Hub Controller common to many Access-points which provides this function; and
3) a means of coordination of the sequential pattern among contiguous groups of patterns.

This function reduces the susceptibility to lost or excessively delayed messages from the interruption of the primary wireless data path. Any co-existing alternate path simultaneously presenting the same message at another port on the Hub Controller is used in lieu of the message at the expected port.

The inventive method may include the following steps:

1. providing a system including a plurality of access points comprising antennae and radio, including alternately used transmit and receive functions, and providing a hub controller connected to and sequentially controlling the transmit function in the access points by multiple electrical conductors;
2. providing wireless communication services from the access points to a plurality of stations;
3. providing an access method utilizing a pure binary physical medium wherein all messages are accomplished by coding and content of a digital bit stream;
4. transmitting asynchronously initiated messages from the access points which include either complete messages to the stations or invitation-to-transmit messages to enable initiation of transmission of messages from the stations when the system is available for message transfer;
5. organizing the access points into contiguous groups;
6. assigning sequence numbers to the access points within a group in a regular pattern; and
7. synchronously activating access points with corresponding sequence numbers from within contiguous groups at time intervals for transmission of messages to the stations or solicitation of requests from the stations.

The time intervals for transmission of messages or solicitation of requests can be synchronized and equal, or unsynchronized and unequal. The time intervals may be the time required to complete the longest required message transaction at any of the activated access points, or may end as soon as it is known that no message transaction is required. Alternatively, the time intervals may be adaptively determined so that any number of message transactions are completed within the interval provided that the elapsed time since any other access point sequence number was activated is under a predetermined maximum.

Alternatively, the method may include activating access points serially within each group, with no fixed timing relationship to other contiguous groups, and testing each access point prior to use to determine whether a potentially interfering access point in a contiguous group is active. This method may include adding the common control processing function where if a first access point has been denied the use of the channel because of the current activity at an interfering access point, a subsequent use of the interfering access point is inhibited until the first access point has been allowed access. This method may also include determining interference probability to the already active and potentially interfered with access point based on distance and signal level such that access points at greater distance or communicating with stations at above average signal level are deemed less susceptible and then selectively allowing simultaneous use of potentially interfered access points.

As a further alternative, the method may include connecting the groups of access points to a common controller with one port per access point where there is commonly controlled timing of access to the system in a selective pattern that results in a substantially lower probability of interference from simultaneous use of access points. This may include providing a common control function within the common controller which is further subdivided into sub-functions including those for scheduling use of each access point, sequencing of traffic to be transferred via each access point, a data base containing access point idle or busy activity status and facts necessary for other decisions, and message frame composition; and where the scheduling sub-function selectively and sequentially enables each access point in the group to send and receive messages considering the activity status of access points in other groups; and where, for each of the access points, the sequencing function arranges waiting messages by priority and by order-of-arrival into queue, and where the sequencing function determines that the time available for a next transmission is equal or greater than the time required before initiating the next transmission; and where the data base includes data for each access point on the assigned group number and assigned sequence number within that group, and the activity status of that access point. This may further include providing a medium access control transmit function which is common and consecutively connected to each of a plurality of ports which comprise a serially activated group on the common controller.

As a still further alternative, the method may include connecting the groups of access points to the common controller with one port per access point in which logical functions are executed where a new use of the system is dependent on the idle or busy activity status of the other connected access points. This may include providing a common control function within the common controller which is further subdivided into sub-functions including those for scheduling use of each access point, sequencing of traffic to be transferred via each access point, a data base containing access point idle or busy activity status and facts necessary for other decisions, and message frame composition; and where, for each of the access points, the sequencing function arranges waiting messages by priority and by order-of-arrival into queue, and where the sequencing function determines that the time available for a next transmission is equal or greater than the time required before initiating the next transmission; and where the data base includes data for each access point on the assigned group number and assigned sequence number within that group, the idle or busy activity status of that access point; and where the data base also includes a qualitative representation of the signal level for the station with which the access point is communicating. This may also include providing a medium access control transmit function which is common and consecutively connected to each of a plurality of ports which comprise said serially activated group on the common controller.

PREFERRED FORM OF PHYSICAL IMPLEMENTATION

The implementation is in the following parts:

1) the algorithms executed in the hub common control function; and 2) the architecture of the Hub Controller.

MAC and Common Control Functions

The MAC (medium access control) largely implements the Access Protocol described in Rypinski U.S. Pat. No. 5,461,627, and it is mostly concerned with transfers between one Station and one Access-point. This invention is concerned with the kind of control that is necessary for simultaneous use of several Access-points from among a larger group of available Access-points. The shorter the radio reach of each Access-point, the greater the importance of this function and the more feasible it is to provide the necessary common control. This invention addresses the main common control function of deciding which Access-points are simultaneously usable and in what sequence such groups will be used either to solicit requests for new use or to transfer queued traffic. These strategies are implemented in only one place for a large number of supported Stations. Therefore it is possible make considerable change in the sequential and simultaneous use strategies without effect on the access protocol in Stations or the per-port MAC and PHY (physical medium signal processor) in the Hub Controller. A number of the algorithms for operation of contiguous sequential groups are described and part of the invention.

Architecture of the Hub Controller

Separate Access-points, distant from each other, provide redundant paths to any particular Station. Each Access-point is connected to a port on a common Hub Controller.

Within the Hub Controller, there is one transmit MAC and transmit PHY function which is selectively switched to one of the ports of a sequential group of Access-points; and there is a receive PHY and part of a MAC for each port the output of one of which is selectively switched after each message to a higher level destination. The remainder of the MAC is common to all ports for a sequential group of Access-points. While the function implied by "selectively switched" above is that of a common single-pole, N-position switch, the function is probably realized by enabling reading or writing to a common backplane bus of large bandwidth relative to the total traffic in the system.

Installation of Access-points

Access-points are installed on opposing sides of obstacles such as walls and steel furniture, and they are spaced closely enough so that most of the covered floor area has an unobstructed path from at least one Access-point. If the path length must be mildly obstructed or near maximum distance, then it is preferred that two or three Access-points provide redundant coverage.

A suitable installation for rectangular floor plan rooms is one Access-point in each of two diagonally opposed corners. If the room is large, additional Access-points may be used in all four corners and at the center of the longer sides. The system philosophy is to obtain near complete coverage by using a sufficient number of Access-points at relatively low cost rather than by over-powering transmitters in a smaller number, and to enhance availability and reliability with redundant overlapping coverage.

SUMMARY OF OPERATION

With above described structure in the common control area of the Hub Controller, there are many different algorithms on which the sequencing and availability of Access-points can be based. These algorithms become more efficient when the degree of unintentional coverage redundancy is minimized.

The basic algorithm is described below. This somewhat idealized case is a necessary reference for other plans of greater efficiency shown in the detail description further below, and which are summarized as follows:

1) Synchronized Sequential Scan;

2) Synchronized Sequential Scan with Adaptive Stepping Time;

3) Synchronized Sequential Scan with Adaptive Stepping Time and Cumulative Opportunity Window; and 4) Adaptive Unsynchronized Sequential Scan.

Omni-directional Access-points in Regular Grid Pattern

Typically, a 4×4 (reuse factor=16) layout of square cells would be necessary to provide sufficient geographic spacing for a high probability that overlap interference between contiguous groups does not exist. Reuse numbers for a square pattern might also have values of 4, 9 and 25.

Generally, simultaneous use of contiguous sequential groups is limited to the same cell number in each sequential group. That implies that if one Access-point is used for a message transfer, many or all of the like numbered Access-points may be unused in several sequential groups while this transfer takes place.

In the simplest system, this loss would be accepted. If the traffic level is high, there might be traffic transferred on more than one Access-point at the same time reducing the loss. Various algorithms are offered to increase utilization of channel time given a fixed size of reuse group. With certain alternate configurations of Access-points which reduce the interaction between Access-points, smaller reuse group size is possible.

Access-points with Directional Antennas

Using directional antennas in combination with natural barriers it is possible to reduce signal levels outside of intended coverage areas. One sequential group may then operate within one contained area (e.g. a room) giving regard only to contiguous rooms or possibly no regard for any other area. The possibilities for Access-points using directional antennae lead to the use of smaller sequential groups and more frequent use of inter-group functions.

DETAILED DESCRIPTION OF A PREFERRED EMBODIMENT

Figure 1:
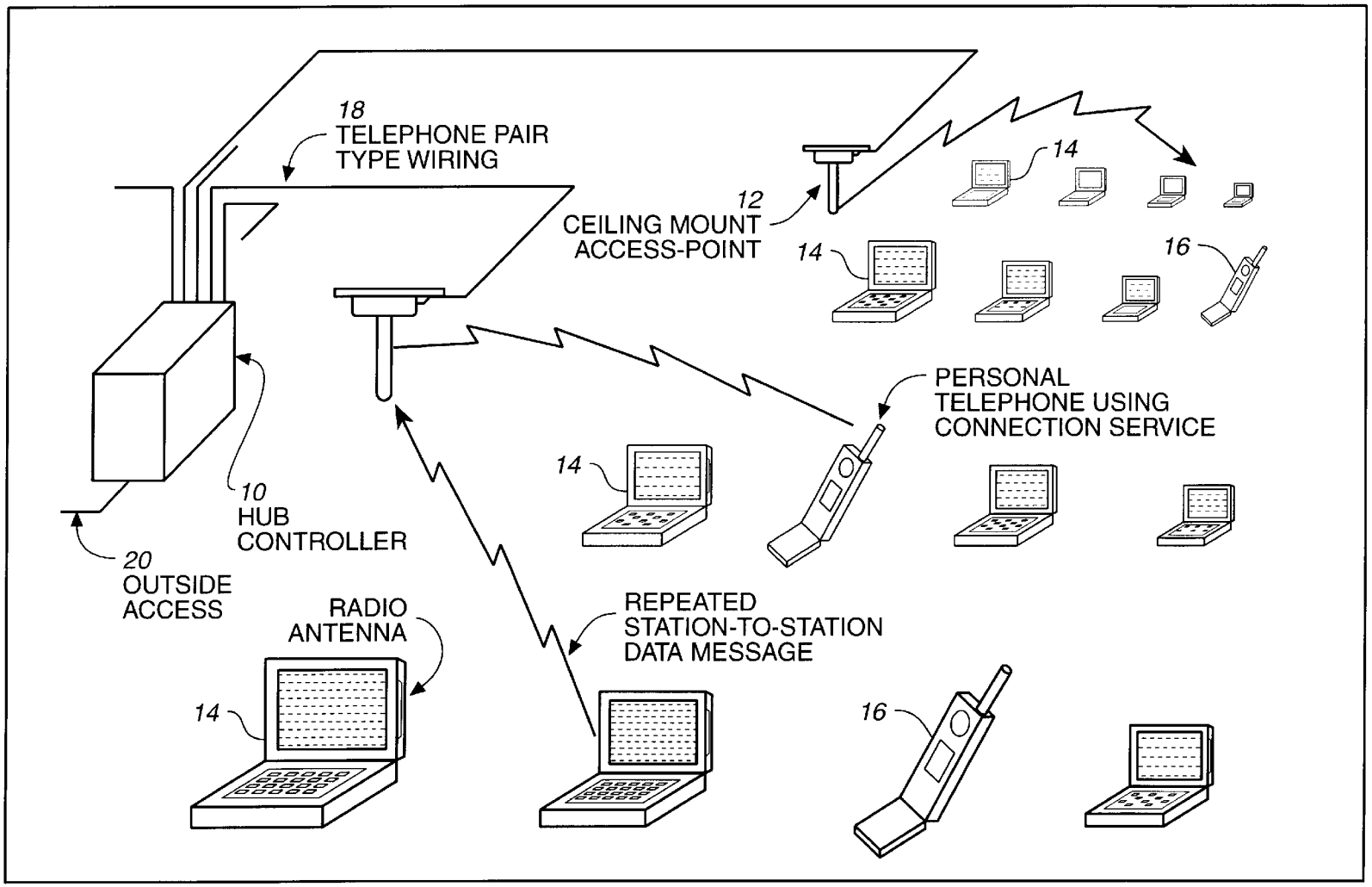
FIG. 1 is a diagrammatic representation of the system environment showing infra-structure components Access-points, Hub Controller, external network links and their interconnection by telephone pairs.

FIG. 1 is a diagrammatic representation of the system environment showing infra-structure components Access-points, Hub Controller, external network links and their interconnection by telephone pairs; and showing Stations which are either portable computers or pocket telephones; and not showing automatic and robotic devices which could also use the wireless access environment. A large fraction of the traffic in this system could be between computers where the users are working cooperatively on a common project. This diagram shows the Access-point as a small equipment linked to the hub controller by telephone pair wiring. It consists of a radio antenna and those components necessary to convert the data content of the radio signal to and from a baseband logical signal conditioned for transmission on the telephone pairs.

Illustrated components include:

10 Hub controller with telephone pair connection to multiple access points and to outside networks.

12 Access points which are in one assembly antenna, radio and modem transducer converting between noisy analog radio signals and a binary data stream conditioned for twisted pair cable transmission.

14 Portable computers or other wireless data communication using devices with integral antenna, radio and modem

16 Personal pocket telephones with integral antenna, radio and modem.

18 Unshielded telephone twisted pairs typically used for PBX building wiring and generally bundled into cables

20 Cable linking hub controller 10 to outside networks which in many instances will be the same as those pairs which link PBX to central office.

Figure 2:
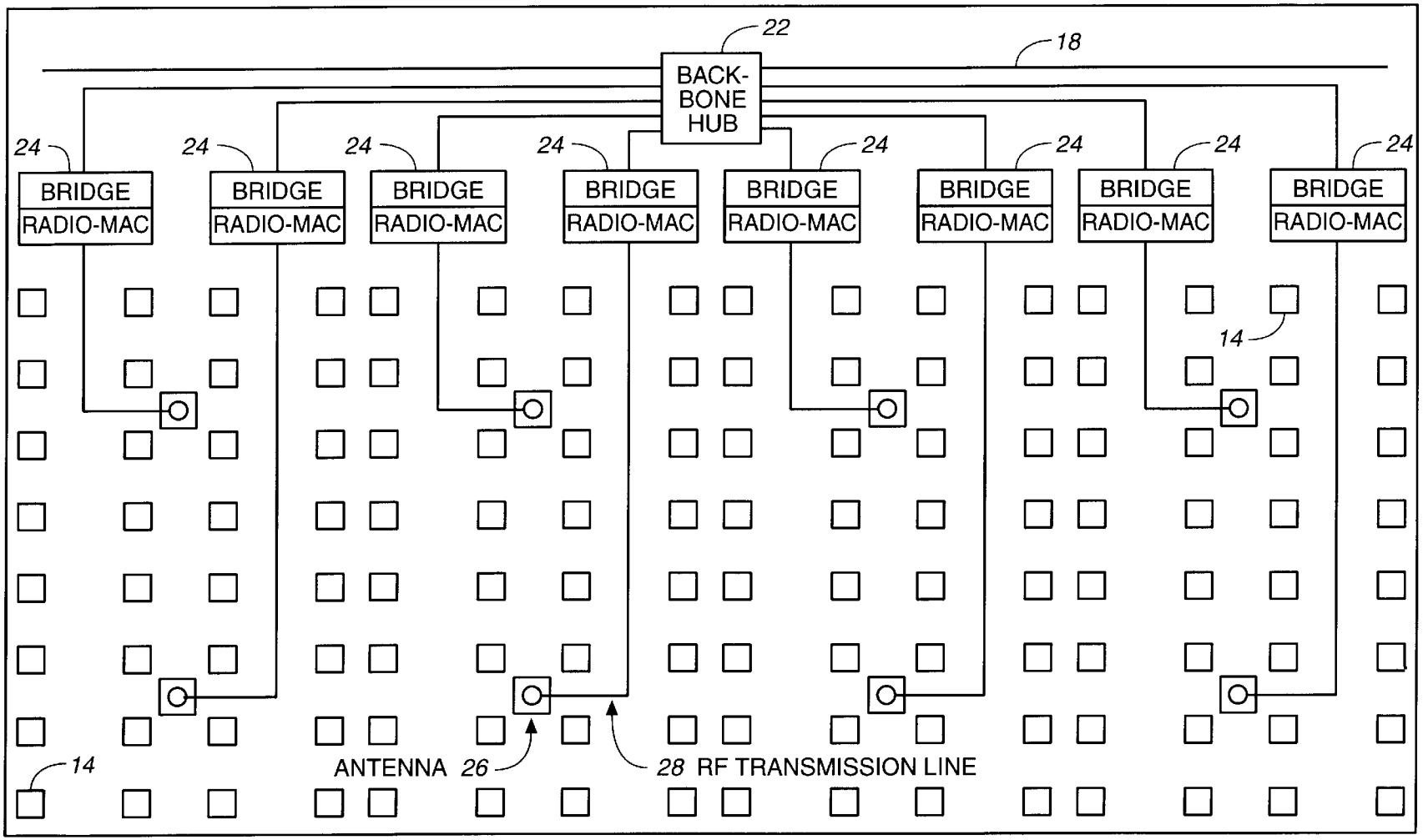
FIG. 2 is a diagram showing one possible arrangement where each Access-point is a "bridged" tap on a common 802.x backbone LAN.

FIG. 2 is a diagram showing one possible arrangement where each Access-point is a "bridged" tap on a common 802.x backbone LAN. In this plan, a Station that moves from one coverage to another changes that Station's internetwork routing from one bridge to another. This invention is an alternative to this arrangement.

Illustrated components include:

22 Local area network hub connecting "star-wired" telephone pairs into a ring or bus configuration and possibly providing some access control functions. The LAN Hub is existing prior art technology and practice.

24 Bridge Units which include a "bridge" function to interconnect the wire and the radio local area networks. The function includes translation between the medium access methods, frame structure and protocol used in each of the networks, and a filtering function which prevents messages which go between stations in the same network from passing through the bridge. It may also contain functions that in some way deal with broadcast or multicast transmissions. There are eight of these units shown in the diagram.

26 Radio antenna located at some distance from the associated radio which is part of fixed bridge unit equipment 24.

28 Radio frequency transmission line which is necessarily larger diameter coaxial cable so that losses at microwave radio frequencies will be low. This kind of cable is more expensive and harder to install than telephone pairs.

Figure 3:
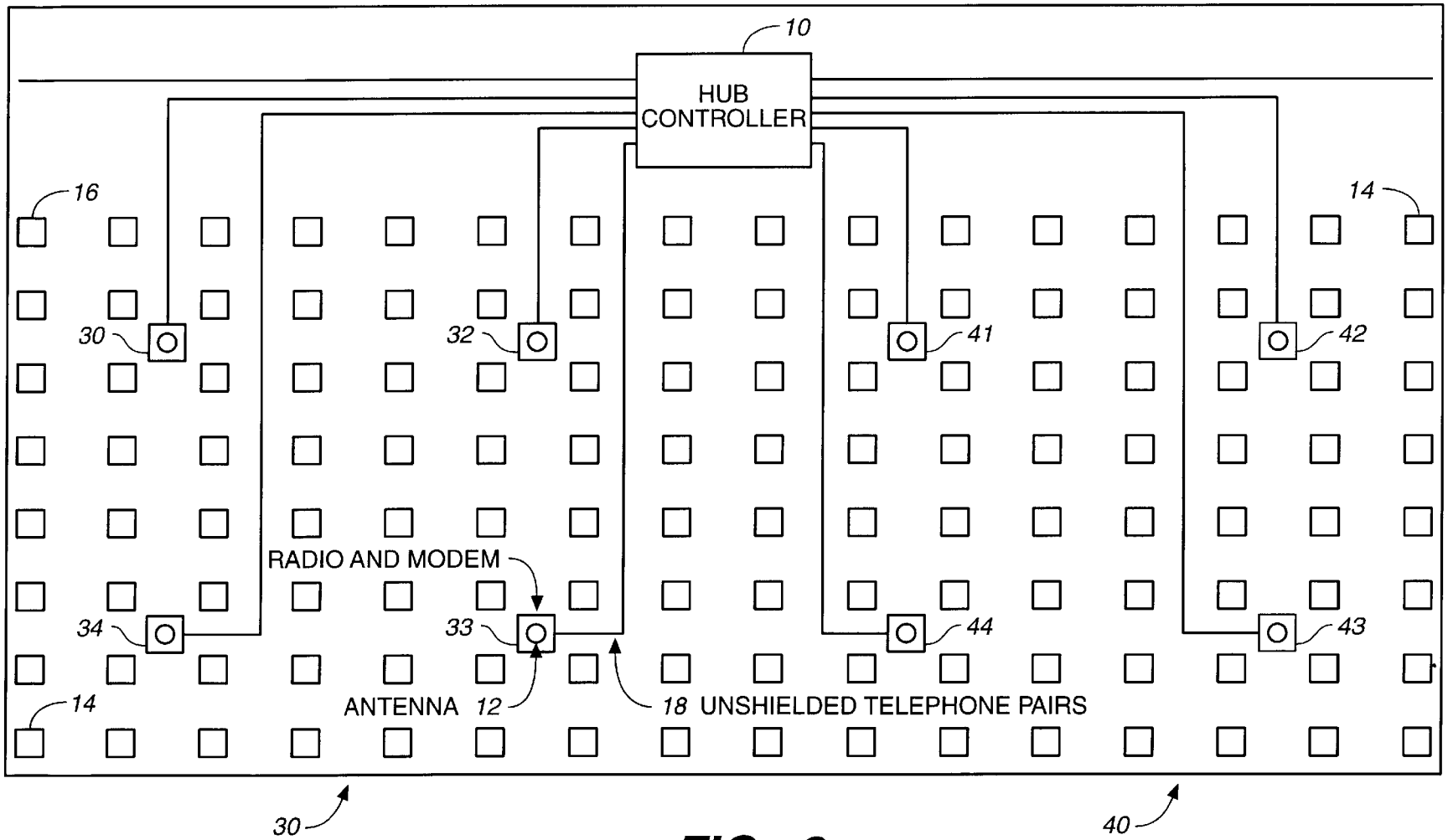
FIG. 3 is the form of the invention, and it shows a Hub Controller common to many Access-points which is bridged to a backbone LAN or other links to external networks.

FIG. 3 is the form of the invention, and it shows a Hub Controller common to many Access-points which is bridged to a backbone LAN or other links to external networks. In this case, the movement of a Station from one Access-point to another is a non-event so far as external network addressing is concerned.

Illustrated components include:

Group 30 (left four access-points)

Group 30 of four access points 31, 32, 33, and 34 are activated in a clockwise sequence in the order 31, 32, 33 and 34. This partitioning of channel availability between access-points may be fixed at 25% for each or adaptive and variable to reflect differences in traffic generated in the four sectors.

Group 40 (right four access points)

Group 40 of four access points 41, 42, 43 and 44 provide parallel and additional capacity with respect to group 30. If access points 32 and 41 are simultaneously active, interference is probable. If like numbered coverages (e.g., 31, 41 . . . ) in all groups are synchronized to operate in the same time allowance, interference is much less probable. It is permissible for 32 to operate in the time allocated for 41 if it is known at the hub controller that there is no traffic for that access point to be carried in that particular interval. The algorithms described in the specification are various ways for contiguous groups to use the time within the group, and modifications to that use caused by activity in surrounding groups.

Figure 4:
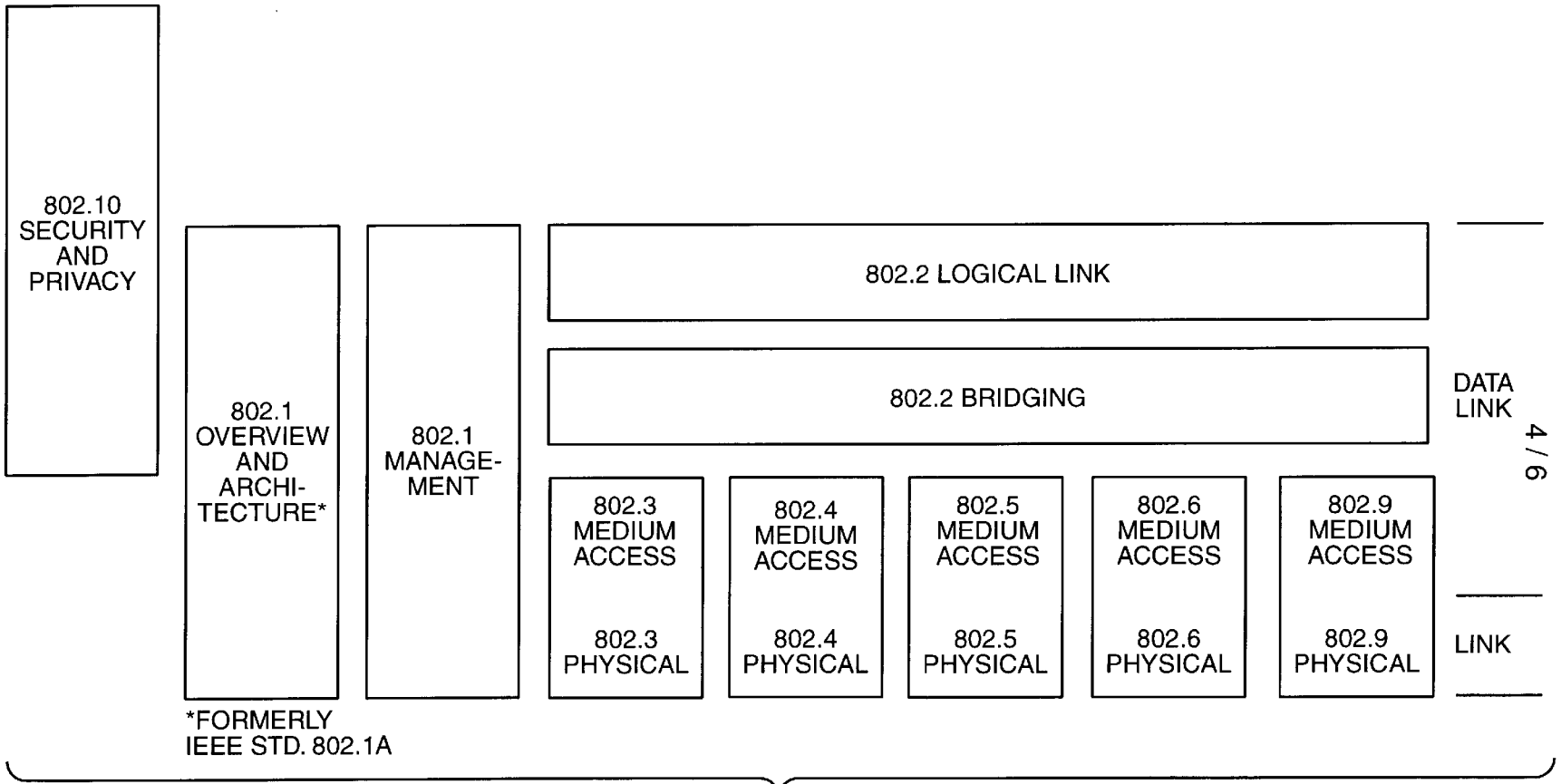
FIG. 4 is transcribed from the foreword of IEEE Std. 802.1D-1990 showing the ISO layering as it is currently presented for wired systems.

FIG. 4 is transcribed from the foreword of IEEE Std. 802.1D-1990 showing the ISO layering as it is currently presented for wired systems.

Figure 5:
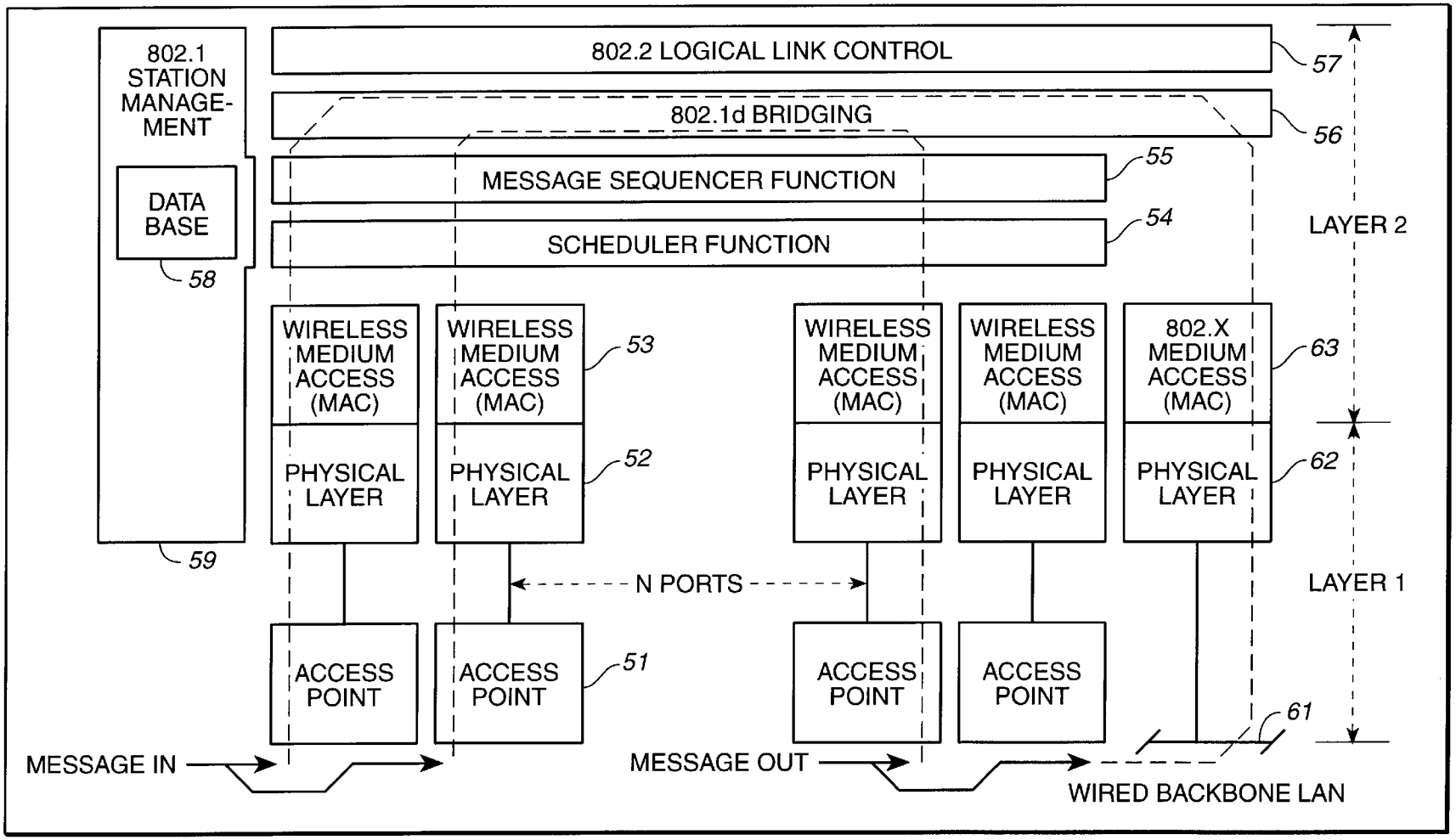
FIG. 5 is also a layering diagram following the IEEE 802 format, but with more detail.

FIG. 5 is also a layering diagram following the IEEE 802 format, but with more detail. It is suggested that the new functions are a part of Station management which provides interlayer functions. Dotted lines are shown to indicate the approximate path of messages within the wireless network and to a port linking the system to an outside network. The outside network port is linked directly to the bridging layer and could use the LLC (logical link control) function.

The diagram does not portray physical layout, but is arranged by logical function. The legended functions in FIG. 5 are:

Layer 1 is the Physical Layer and includes all of the logic functions associated with conditioning the signal passing through the transmission medium. This layer does not understand or alter the bit stream.

Layer 2 this layer reads and generate the header of burst messages, and it repeats addressing and message content between the physical and higher layers. Properly, Layer 2 should not contain physical medium dependent functions, however this purity of definition is not always adhered to. Forward error correction and scrambling are properly physical medium functions often implemented as part of the medium access logic. Layer 2 is sublayered for MAC and LLC functions.

51 Logically, the access point is a physical medium repeater in that the same information goes in and comes out. The change from baseband data to radio frequency and back is not logically significant. The diagraming makes a distinction which may be helpful in connecting the logic and the physical parts but which is without logical significance.

52 This is the PHY layer in which all PHY dependent functions are performed. This layer includes clock acquisition and bit synchronization and detection of start and end delimiters. Scrambling and forward error correction would be in this layer if required.

53 The wireless medium access control is the MAC function. This logic deals with destination and source address and the control of access to the transmission medium. This process is done transaction by transaction. The MAC deals with the possibility of more than one message being offered for transmission at a single instant.

54 The scheduler partitions available time between the ports and between the transmit and receive functions. Any mutually exclusive function within one group of access points or between contiguous groups is controlled by algorithms in the sequencer function.

55 The transmit sequencer uses the channel time allotted by the scheduler for transmission and reception on each particular access point. The traffic backlog is sequenced considering priority, age, length, service type and time remaining.

56 The bridging layer is where messages addressed to a station served by the Hub and received on any input port are relayed to the destination MAC. In addition external destinations are recognized and repeated to the MAC for the external access ports. It is possible that externally addressed destinations will also be looped through LLC as well as the bridging layer for connections to networks of differing protocol. Segmentation and desegmentation between long streams of bits in connections or large packets and radio medium bursts is properly performed at the bottom of the LLC. This function is best included at the top of the bridging layer so that it is only invoked for messages passing in and out of the wireless system.

57 The LLC or logical link control layer is the top layer of the data link layer which is intended to provide a medium independent communication facility to network and transport layers above it. This layer responds to or requests for connectionless unacknowledged or connection type data services from higher layers. This layer delivers to and receives from the MAC layer formatted header and forwarded data including source and destination address in LAN format. LLC operation is generally outside of the scope of this invention, however it is important to interworking with outside networks.

58 The data base is the repository for all necessary station status, location, authorization and capability facts. In addition, equivalence tables for different types of short, LAN, telephone, equipment and personal identification addresses are maintained.

59 The Hub Station management function is shown as common for all ports with scope over all associated stations and bridged ports to other networks. This is a somewhat different perspective than LAN where logic is entirely peer-to-peer. Much of the management function is managing, maintaining and using the data base. All remaining necessary functions not specifically included in other blocks are in the management block (e.g., registration, association, poll and sleep mode). Reservation of future capacity is provided by management functions to assure the timely availability of channel access for successive bursts in segmented packets and connections.

61 Legacy networks generally use well defined metallic physical mediums including both telephone pairs and coaxial cable. In most cases these mediums are multi-drop rather than point-to-point.

62 The associated medium specific physical layer provides the necessary modem, signal processing, synchronization and delimiting functions.

63 This MAC is specific to the type of interconnected network. Existing LAN protocols like IEEE 802.3, 802.5 and 802.6 (for both connectionless and connection type services) have their own definitions of frame format and access method. Provided that there is no address translation into public network or internet addresses, these networks can be reached by bridging as shown. These networks are external to the invention but must be considered for interworking.

Figure 6:
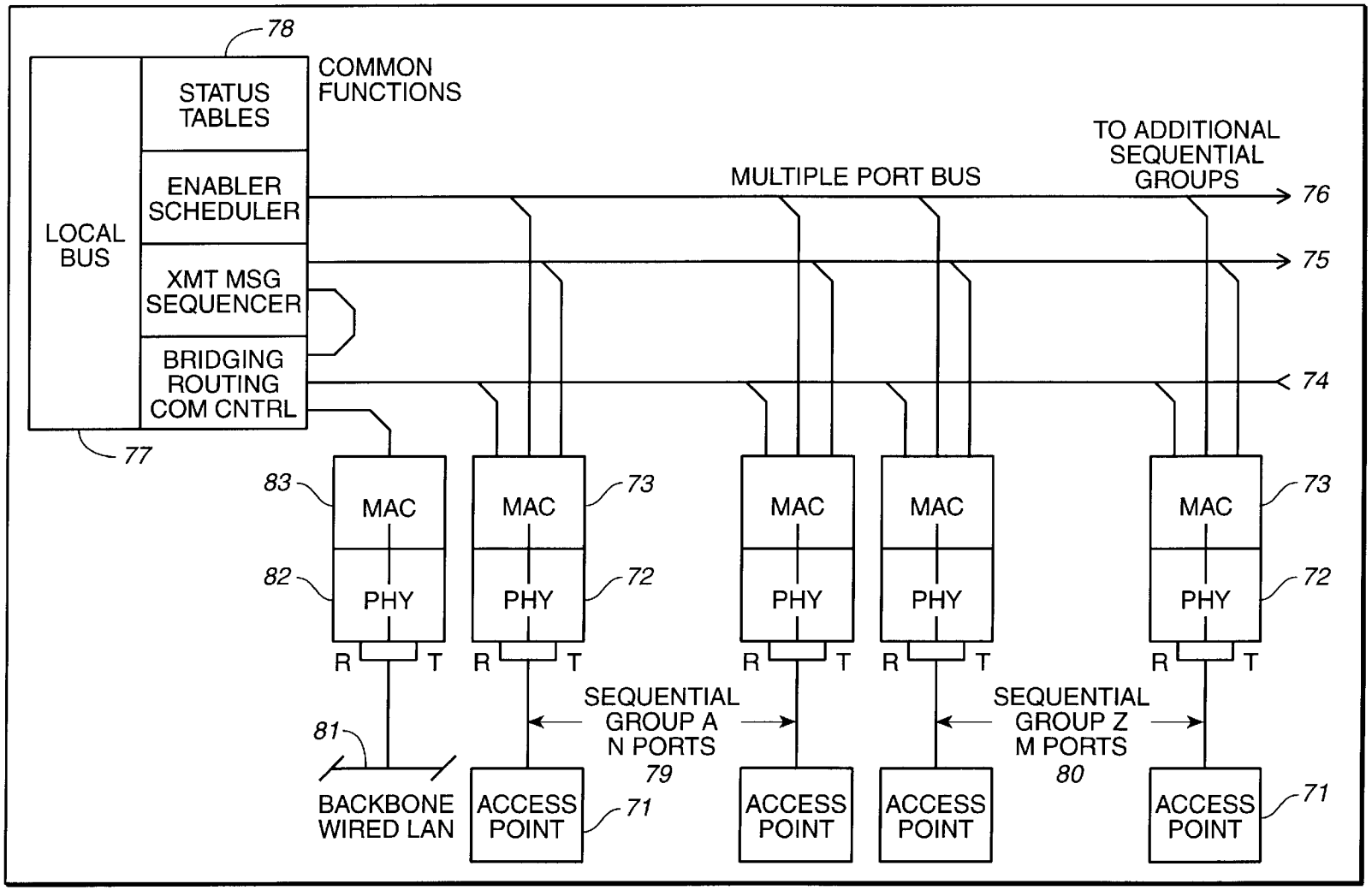
FIG. 6 shows the same elements as FIG. 5 but in a way related to hardware design.

FIG. 6 shows the same elements as FIG. 5 but in a way related to hardware design. The legended functions in FIG. 6 are as follows:

71 The physical implementation of the access-point with the functions of 51.

72 The physical implementation of further elements in the PHY layer with the functions of 52.

73 The physical implementation of the MAC sublayer with the functions of 53.

74 The data bearing bus for received messages flowing from access-point to the common control and switching hub. The arrows at the right end of the buses indicates the direction of information flow for 74, 75 and 76.

75 The data bearing bus for transmitted messages flowing to the access-points from the common control and switching hub.

76 The transmit enable bus for the access-point transmit function.

77 A local bus within the common control function for interconnect its parts consisting at least of those blocks defined.

78 The common control and switching hub implementation as a whole. The functions of the internal blocks are the implementation of functions 54-59 in FIG. 5.

79 The indication that N ports may be members of sequential group A. It is implied that the use of any port within one group is mutually exclusive unless permitted by algorithm and status conditions.

80 The indication that M ports may be members of sequential groups B to Z with the same restrictions as group A.

81 The implementation of a physical medium of an outside network identical to 61.

82 The implementation of PHY layer services for an outside network with the function of 62.

83 The implementation of a MAC sublayer for an outside network with the function of 63.

The common functions intercommunicate by means of a local bus 77. The ports are positions on a further bus 74-76 which links them with the common equipment 78. This figure also shows that only transmitted messages for wireless stations pass through the message sequencer and that the bridging function receives messages from stations directly routing them back to the wireless network or to an outside network. This figure also shows that ports are organized in sequential-use groups 79 and 80, and that one hub controller, 78, may and should serve several groups.

OVERVIEW OF THE INVENTION

This invention addresses the main common control function of deciding which Access-points are simultaneously usable and in what sequence such Access-points within one group will be used either to solicit requests for new use or to transfer queued traffic. A number of the algorithms for operation of contiguous sequential groups are described; and then also the relevant architecture and functions necessary to implement these algorithms in the Hub Controller. A further description of possible and advantageous plans for Access-point function and topology using these algorithms is given.

The main parts of the detailed description are:

1) Inter-Sequential-Group Operating Algorithms

2) Architecture of the Hub Controller

The Physical Medium Layer

The PHY sub-Layer

3) The MAC (Medium Access Control) sub-Layer

3) Access-point Configurations

It is possible to operate sequential groups independently at something less than the maximum possible carried traffic load. With Independent Operation of Scan Groups, the larger the group size and the lower the traffic, the more successful the operation. Also, the less the coverages overlap, the more effective independent operation will be.

A main objection is that it impossible to calculate the worst case delay. At best, a probability of excess delay can be computed. For some applications, this value is a requirement. The essence of the invention is securing increased capacity and decreased probability of lost messages through more structured use of time when large numbers of Access-points are used to provide sufficient capacity and coverage.

INTER-SEQUENTIAL-GROUP OPERATING ALGORITHMS

Four different relationships between contiguous sequential groups, each advantageous in a particular context, are identified as follows:

1) Synchronized Sequential Scan with Regular Stepping Time;
2) Synchronized Sequential Scan with Adaptive Stepping Time;
3) Synchronized Sequential Scan with Adaptive Stepping Time and Cumulative-sized Opportunity Window; and
4) Interference-adaptive Unsynchronized Sequential Scan.

These algorithms are different refinements to better structure and utilization of channel time considering the capacity of the system as a whole.

Synchronized Sequential Scan

This is the simplest and default algorithm in which each Access-point in one sequential group ("Scan" group 79, 80 in FIG. 6) is used consecutively along with the same numbered Access-point in all contiguous groups. The amount of time allowed for each step in the sequence could be the worst-case maximum time usage which is for a Station-originated maximum payload packet or segment which is about 250 μsec for a medium signaling rate of 12 Mbits/sec. The worst case access delay is either 3 or 15 times the stepping rate for sequential group sizes of 4 or 16.

A great deal can be done to improve the average access delay when the system is not fully loaded, but the value of efficiency is greatest when the system is operating near its capacity limit. The benefits of improvement are also more important with higher numbers of Access-point in the sequential (or "scan") group.

Synchronized Sequential Scan with Adaptive Stepping Time

This name is given to an algorithm where the system stays at one sequence number only as long as necessary. It is possible that there will be no offered traffic on any Access-point over the total of the contiguous scan groups. It is also possible that for a large proportion of the time the length of the transferred payloads will be less than the maximum allowed.

With this algorithm the average access delay will be far less than without the adaptive step size. It also means that with more frequent access opportunities, much lost channel time will become usable.

The worst-case assumption of the regular stepping algorithm described above assumed that saturating traffic was equally divided among Access-points, and this is highly improbable. This adaptive algorithm would greatly increase the capacity of the system when a minor proportion of the Access-points carry a preponderance of the traffic.

Synchronized Sequential Scan with Adaptive Stepping Time and Cumulative-sized Opportunity Window This algorithm is a further refinement of the adaptive algorithm which would allow multiple transfers on demand at one step in the sequence provided that the elapsed time was less than worst-case delay for the next Access-point to be used (also the one with the longest elapsed time since last given the opportunity for use.) In this way time not used by earlier Access-points in the sequence is available for the currently enabled Access-point.

For example, a particular Access-point could clear a priority maximum length segment to a Station, and then from a Station before issuing an invitation provided only that all this could be done before the previous access opportunity interval for the next Access-point had reached a critical value. In a 16 sized scan group with a worst case window size of 250 μsec per step where the last 14 steps had only taken 1,000 μsec rather than the permissible 3,500 μsec, then the next Access-point could use up to 2,500 μsec in consecutive multiple transfers.

This algorithm is best adapted to "wild card" sequence numbers which are in addition to the regular pattern to provide coverage in irregular locations. It is not necessary to enable the "wild card" Access-points until the interval since their last use becomes critical.

Adaptive Unsynchronized Sequential Scan

This is the case where the sequential scan groups continue to exist, but there is no synchronization of use between scan groups. The rule for the scanning sequence is that the Access-point longest waiting is the next to be used within one scanning group, with the exception that if this station has waited less than a critical interval relative to the worst case delay allowed in the system, its use may be deferred in case of conflict with Access-points in other scan groups.

For each Access-point, an identification list of potentially interfering Access-points is maintained. A status table of all Access-point in the system in which idle or busy status with estimate of time to end busy status is included in the common control. When an Access-point becomes eligible for use, the common control enables that use contingent upon non-simultaneous use of the particular interference set of Access-points. It is also possible for the common control to delay that enablement until use of an interfering Access-point is completed. To deal with multiple Access-points awaiting the end of use of another, the priority is based upon length of waiting time with the longest having the highest priority. This algorithm will be most effective when the coverage of each Access-point is so well contained that the list of interfering Access-points for each Access-point contains a small number.

ARCHITECTURE OF THE HUB CONTROLLER

The aspects of the Hub Controller now relevant are those which deal with the interaction of numbers of Access-points on each other when they all operate on a common channel and are separated by time and space but not frequency. The transactions between one port of the Hub Controller and the user Station are defined in Rypinski U.S. Pat. No. 5,461,627.

At the Hub Controller, the interface to other networks is governed by IEEE LAN Standard 802 covering the Link sub-Layer Control (LLC) function with which all of the various 802 MAC sub-layer and PHY layers must be compatible. The LLC and MAC sub-layers together are the Data Link Layer 2 of the ISO definition. This relationship is shown in FIG. 4 from the foreword of recent IEEE P802 Standards, e.g., ANSI/IEEE Std 802.1D-1990, "Media Access Control (MAC) Bridges," SH 13565 Mar. 8, 1991, Institute of Electrical and Electronic Engineers, Inc., 345 E. 47th Street, New York, N.Y. 10017-2394 USA. An important part of the Hub Controller is the provision for concurrent processing of data packets and virtual circuits for isochronous network services; but these functions are outside of the scope of the present invention.

The Hub Controller must be common to a number of Access-points sufficiently large that most movements of Stations between coverages of individual Access-points remain in the scope of the same Hub Controller. E.g. one Hub Controller is used for a small building, major sectors of a large factory, one floor of a high-rise building. External networks can then address the Station considering all of the commonly controlled Access-points as one network.

The architecture of the Hub Controller can be described in terms of the implementing hardware with a wide range of possibilities, or by the function following the layering model of the International Standards Organization. Both are useful and will be used.

This invention is concerned with only part of the function of the Hub Controller, but that part is not easily understood without also covering the context in which it is placed. The invention is concerned with those functions that are necessary for operating a large number of Access-points as a single network.

The Physical Medium Layer

Referring now to FIGS. 5 and 6, the Physical Medium layer 1, 62, contains both the physical medium function (PHY), 52 and 72 and the medium access control (MAC), 53 and 73, which are often interdependent. An objective (not completely satisfied) is that the next higher (sub-) layer should be independent of the medium and access method.

The PHY sub-Layer

The PHY sub-layer contains:

1) the physical medium, 51 and 71, itself, wired or wireless, the signal passing through it, and
2) the functions necessary to make the upper interface entirely logical; and these functions include signal conditioning as performed by modems for band-limited mediums, clock recovery, framing, block coding, sync detection and alignment, forward error correction if used and possibly a running means of detecting signal validity.

The PHY layer is usually further subdivided into the transmission part, 61 and 81 (e.g. cable type), and the conditioning part, 62 and 82 (e.g. radio or optical transducer). The Access-point is an analog signal repeater (digital values out equal values in), and so it plays no part in the logical design of the system even though it is essential to the overall function.

There must be a MAC function within the PHY layer for each Access-point. This is necessary so that a complete message can be received on multiple Access-points without advance knowledge of which will be used. At the output of the PHY there must be an indication that the buffer memory has been loaded, and that the signal received is apparently valid. The parsing of the header and other interpretation of the incoming data is not done in the PHY layer.

Since the use of Access-points within one group is sequential, only one set of the transmit PHY function is required for each group. It may be switched between Access-ports. The transmit PHY could include adaptation function to anticipate or correct transmission distortion in the medium between the Hub Controller and the Access-point.

It is probable, that eventually the MAC and PHY circuitry will be so inexpensive that it will be less costly to leave the entire port electronics integrated even though portions are lightly utilized. The PHY layer might contain circuits to enable remote testing by loop back of the port transmit-receive lines. This function would be activated from the wired side of the Hub Controller.

The MAC (Medium Access Control) sub-Layer

This layer is entirely logical (digital), and it is where the frames, formats, fields and payloads are coded into and decoded from digital bit streams (as defined in the copending patent application). Given a shared medium environment, it is the MAC function to provide orderly access to that medium with an acceptably low level of failures from contention. Recovery from failed access attempts is generally part of the MAC, however general recovery from failed message transfers is a higher level function provided that it is not overworked by unusually incompetent PHYs.

In this architecture, the MAC is partly a per-port function and partly a common function. This is not the same as telephone practice where control and selection of channels is done at layer 3 where the originating end communicates with the terminating end via a common signaling channel to negotiate the channel to be used.

There is no precedent in 802 LAN practice since it only addresses shared mediums, and not channelized systems. In 802 type architecture, the common function would be part of an interposed bridging layer above a per-port function containing MAC and PHY. For voice data-integration (see 802.6 and 802.9), the PHY is multiplexed with separate upper layers for each of these service types. The deficiency of this model is that there is no provision for receiving multiple copies of the same message on different ports using this event for greater success probability. There is also no function in which the use of one port is conditioned on the status of other ports.

Convergence with the 802 LAN practice must come at the bottom of the LLC sub-Layer where the entire radio system served by the Hub Controller looks like one network bridged at MAC level to any other 802 network. This is what makes the movement of a Station from one to another Access-point a non-event for interconnected external networks. The Hub Controller is a multi-port MAC bridge, where the common function is an extension of normal bridging architecture as given in the previously referenced IEEE Std 802.1D-1990.

The Per-port MAC Receive Function

Each message from the PHY layer is received at logic level with parallel indications of probable validity of the data stream. The decode processing of frames, headers and payloads as defined by the access protocol take place in this area. The responses or lack thereof to the various invitation messages arrive here.

In the per-port MAC function, incoming data frames are received, evaluated for accuracy and made available for higher layer routing or processing. The source address and system number are screened for qualifications for access. Such messages are stored until either a new message is received, there is a command to erase, or it is read out by the higher layer function. Most of the header content and the payload are passed to the common or bridging layer for further processing.

The Per-group MAC Transmitting Function

This function composes all transmitted messages passing them to the PHY layer, and it does this one port at a time within a sequential group. Whether this is done with one MAC switched consecutively to the ports or whether there is one MAC per port consecutively activated is an implementer's detail. The addressing and contents of each message are provided by a higher layer, excepting access-protocol-defined messages (e.g. invitation-to-transmit/register, poll, grant, acknowledge.)

The decision to initiate any enabling message or sequence of messages is not made within the MAC, but in the "scheduler" portion of the common control. The MAC knows nothing of what is happening in other Access-points, but it does know that it is commanded to send an invitation message or a data packet or segment to a Station.

After a sequence has been initiated, consecutive steps are controlled by communication between the transmit and receive MAC functions. The scheduler function is not part of 802.1D, and it is part of this invention.

The Common Control and Bridging Function

When limited to links between Access-points or message repeating by one Access-point or connection to one or more other networks at the MAC level, the routing function is called "bridging." Generally, routing is a function used in more complex links between networks, normally but not necessarily a layer 3 or 4 function. The Bridging function depends upon destination address analysis to select messages for relay to external networks or for retransmission on the appropriate Access-point for other Stations within the present network.

There are two levels of common control for initiation of message transmission: 1) within one sequential group, and 2) relating sequential groups. These two areas are intermixed in varying degrees for the different algorithms described above. An alternate term hereafter used for this function within the common control is "scheduler;" and this is the relevant part of the common control for this invention.

Segmentation and desegmentation between long streams of bits in connections or large packets and radio medium bursts is properly performed at the bottom of but within the LLC. If it is an objective to use existing LLCs that have no provision for segmentation, then implementers may put the function at the top of the MAC. The sequence of the stack is no different, but the formal layer definitions are somewhat bent. In this system, segmentation still must be accomplished immediately under the LLC because it is only invoked for external transfers. Transfers through the bridging layer between wireless stations occurs segment-by-segment.

The provision of a segmented transmission function is a detail of the hub architecture.

"Wild" Card Function

The number of positions in a sequential group may be increased over that required for a regular geometric pattern. The additional positions are used for Access-points that are positioned to satisfy coverage needs of irregularly located walls and building shapes. Wild card sequence positions are undesirable because this increases the scan time for the entire network to accommodate a need which may affect only a small fraction of total traffic.

Scheduler for Synchronized Sequential Scan with Regular Stepping Time

Synchronized operation requires entry of a configurable parameter which corresponds in $\mu$sec to the longest permitted transmission which then becomes the stepping time. The implementation probably computes this value from the entry for value of the longest permitted data payload.

In common with all of the algorithms, the configuration must also specify the largest number of Access-points in one sequential group and the parameters of a table associating each Access-point port with a group and sequence number. Also in common with all other algorithms, the scheduler consecutively enables for one step time the corresponding ports of multiple groups. The scheduler does not specify the functions to be performed when enabled. When a port is enabled, another area of the common control specifies as default the appropriate invitation message unless there is a pending packet or segment for transmission on the currently enabled Access-point.

Scheduler for Synchronized Sequential Scan with Adaptive Stepping Time

When adaptive stepping time is used, the default stepping time is the total duration of one invitation-to-transmit (or request or register) and one response plus propagation time. This interval is entered as a configurable parameter or it is computed within the system from the message dimensions directly. When there is a response, the system does not step until the completion of that transaction for which there was a response, or the longest of multiple parallel responses.

From the configured parameter for the longest permitted transmission, the system limits use of any one Access-point to this value for multiple transactions on a single enablement. This is useful with short messages. The average interval between access opportunities for stations will be much less than the worst case interval with regular stepping time.

Scheduler for Synchronized Sequential Scan with Adaptive Stepping Time and Cumulative-sized Opportunity Window The operation in this mode is similar to that of the scheduler for the adaptive stepping time algorithm described immediately above, except that there is a parallel time counter which indicates the time since the longest-waiting Access-point was last enabled. The maximum value which is within the design maximum for this counter is $(N-2)\times$the maximum stepping time where N is the largest number of Access-points in one sequential group. The time indicated on this counter will generally be less than this value reflecting less than maximum use of channel time by preceding Access-points. The amount by which it is less than maximum is the measure of the maximum time that the current Access-point may hold the channel making multiple transfers within one enablement. In this way time not used by earlier Access-points in the sequence is available for the currently enabled Access-point. This method is appropriate for either a single or multiple sequential groups.

Scheduler for Unsynchronized Sequential Scan with Adaptive Interference Criteria In this mode each sequential group, generally operates independently, however the criteria for enabling each individual Access-point depends on the status of other nearby Access-points which if active could be interfering. Within one group, any of the above adaptive sequencing methods can be used.

Interfering Access-point Table

For each Access-point, the scheduler would contain an "interference table" listing those Access-points which cannot be used simultaneously. This table might be enhanced by sorting interference into classes (e.g. quite probable, moderately probable and possible) so that the level of certainty of non-interference practices varies as a function of traffic loading and is only compromised at Access-points when and if actually needed.

It is also possible to take into account the level of signals at active Access-points. Strong signals imply greater resistance to interference. Suppose that signal levels are known to be high at an Access-point graded moderately probable. That grading could be reduced to possible considering signal levels. Assume that Invitation messages are allowed with interference graded possible, but data transfers are not. Permission-to-use (grant) could be withheld or delayed on this basis.

Messages to Stations could have a lesser requirement for absence of interference than the reverse direction based on easier retry algorithms. It is possible that the registered Access-point is subject to interference but an alternate is not.

There is some art in the software or hardware implementation of the interference table. It is important that only one decision at a time be made, so that there is no instability from changes due to simultaneous reading. The design of this table may be invention by itself to provide the speed and parallelism required.

Delayed Access Processing Algorithms

The procedure for Access-points marked interference-unavailable may use one of the following inhibit release algorithms:

1) wait until available, or
2) wait until available with inhibiting of next use of interfering Access-points, or
3) wait a defined time and then skip and retry, or
4) skip and retry next opportunity, or
5) skip and retry next time in sequence.

The delayed access procedure only becomes important when the traffic demand approaches the capacity of the system. With the interference adaptive and the cumulative opportunity window algorithms active, a high degree of system capacity can be utilized. These logics enable efficient handling when the demand is very unequally distributed between Access-points.

The traffic demand is likely to have sudden peaks that are short duration. During these peaks it is desirable to maintain FIFO (first-in, first-out) queuing with the backlog held in buffer memory. For utilization to come near 100% capacity, it is necessary that there be a queue. Predominantly, the access delay will be less than period of access opportunities (an extended interval relative to one message duration which would be assumed with one channel and Erlang C blocking).

1) wait until available is not a desirable algorithm, and there is no implementation advantage over 4) or 5) above.
2) wait until available with inhibiting of next use of interfering Access-points is a highly adaptive algorithm. It includes a mechanism which has a FIFO effect favoring those already in queue over those who have not yet made a request.
3) wait a defined time and then skip and retry is a usable algorithm, however the time lost from waiting may be more than is gained.
4) skip and retry next opportunity is the preferred simple algorithm. When blocked, the current Access-point is skipped and the next one tried. After finishing with the next Access-point the current one is tried again. This algorithm might get complex with too many inhibited Access-points, but it is potentially a good tradeoff between good performance and simplicity of implementation.
5) skip and retry next time in sequence leads to a longer waiting time for delayed access than 4) above, however it is not subject to the difficulties of re-entrant logic.

Common Control Message Sequencer

The above described algorithms deal with control of availability of Access-points. After an Access-point becomes available, that channel time is used in a way defined by the message sequencer which has the following main functions:

1) to maintain an orderly queue of traffic awaiting transmission,
2) to recognize and transfer to the appropriate queue traffic received for Stations in the network, and
3) to direct received messages into queues for forwarding to other networks, and
4) to interlace sequence of transmitting and receiving functions.

The message sequencer, 55 and 78 (FIGS. 5 and 6), implements the bridging function but is more specific in implementing algorithms that determine the sequence in which the medium is used when there is heavy traffic. there is almost no function in the message sequencer in which the events for a particular Access-point are dependent on the status of other Access-point excepting only that all other Access-points are potential traffic generators. The functional possibilities for the message sequencer are all those contained in the access protocol.

Common Control Data Base

All areas of the common control function are dependent on various parameters, statuses, and values all of which are apart from those which are part of the system as defined at manufacture. The types of parameters which must be stored in the data base, 58, many of which are essential to the implementation of the above described algorithms, are:

1) Configurable parameters--may be determined at time of installation, and are usually different between systems.
   a) table of Access-points and their assigned sequential group and sequence numbers,
   b) tables of interfering Access-points for each installed Access-point,
   c) permissible worst-case access delay for packets and for priority virtual circuits,
   d) permissible number of resends of failed transfers.
2) Dynamic status registers:
   a) Traffic status tables for pending messages ready for transmission to Stations sorted by Access-point, priority, waiting-time for transmission.
   b. Access-point status tables sorted by Access-point for status conditions active/idle, current received signal level category.
   c. Access-point tables sorted by group for time since last access enablement.
   d. Registered Station status tables sorted by address and system number and associated Access-point for:

registration active, current active/idle status, current assigned Access-point, usable alternate usable Access-points, class of systems services supported, alternate address.

These data base and status table functions are meant to give an indication of the scope of the essential functions. Additional functions are certain to be added without departing from the intent of this invention.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A method for controlling a common channel wireless access premises area communication network, said control method comprising the steps of:

providing a system including a plurality of access points comprising antennae and radio, said access points including alternately used transmit and receive functions, and further including a hub controller connected to and sequentially controlling the transmit function in said access points by multiple electrical conductors;

providing wireless communication services from said access points to a plurality of stations;

providing an access method utilizing a pure binary physical medium wherein all messages are accomplished by coding and content of a digital bit stream;

transmitting asynchronously initiated messages from said access points which include either complete messages to said stations or invitation-to-transmit messages to enable initiation of transmission of messages from said stations when said system is available for message transfer;

organizing said plurality of access points into contiguous groups;

assigning sequence numbers to the access points within a group in a regular pattern; and synchronously activating access points with corresponding sequence numbers from within contiguous groups at time intervals for transmission of messages to said stations or solicitation of requests from said stations.

2. The control method of claim 1 wherein said time intervals for transmission of messages or solicitation of requests are synchronized and equal.

3. The control method of claim 1 wherein said time intervals for transmission of messages or solicitation of requests are unsynchronized and unequal.

4. The control method of claim 3 wherein said time intervals are the time required to complete the longest required message transaction at any of the activated access points, or to determine that no message transaction is required.

5. The control method of claim 3 wherein said time intervals are adaptively determined so that any number of message transactions are completed within the interval provided that the elapsed time since any other access point sequence number was activated is under a predetermined maximum.

6. A method for controlling a common channel wireless access premises area communication network, said control method comprising the steps of:

providing a system including a plurality of access points comprising antennae and radio, said access points including alternately used transmit and receive functions, and further including a hub controller connected to and sequentially controlling the transmit function in said access points by multiple electrical conductors;

providing wireless communication services from said access points to a plurality of stations;

providing an access method utilizing a pure binary physical medium wherein all messages are accomplished by coding and content of a digital bit stream;

transmitting asynchronously initiated messages from said access points which include either complete messages to said stations or invitation-to-transmit messages to enable initiation of transmission of messages from said stations when said system is available for message transfer;

organizing said plurality of access points into contiguous groups;

assigning sequence numbers to the access points within a group in a regular pattern;

activating access points serially within each group, with no fixed timing relationship to other contiguous groups; and testing each access point prior to use to determine whether a potentially interfering access point in a contiguous group is active.

7. The control method of claim 6 further including the step of:

adding the common control processing function where if a first access point has been denied the use of the channel because of the current activity at an interfering access point, a subsequent use of said interfering access point is inhibited until said first access point has been allowed access.

8. The control method of claim 6 further including the step of:

determining interference probability to the already active and potentially interfered with access point based on distance and signal level such that access points at greater distance or communicating with stations at above average signal level are deemed less susceptible and then selectively allowing simultaneous use of potentially interfered access points.

9. A method for controlling a common channel wireless access premises area communication network, said control method comprising the steps of:

providing a system including a plurality of access points comprising antennae and radio, said access points including alternately used transmit and receive functions, and further including a hub controller connected to and sequentially controlling the transmit function in said access points by multiple electrical conductors;

providing wireless communication services from said access points to a plurality of stations;

providing an access method utilizing a pure binary physical medium wherein all messages are accomplished by coding and content of a digital bit stream;

transmitting asynchronously initiated messages from said access points which include either complete messages to said stations or invitation-to-transmit messages to enable initiation of transmission of messages from said stations when said system is available for message transfer;

organizing said plurality of access points into contiguous groups;

assigning sequence numbers to the access points within a group in a regular pattern; and connecting said groups of access points to a common controller with one port per access point where there is commonly controlled timing of access to the system in a selective pattern that results in a substantially lower probability of interference from simultaneous use of access points.

10. The control method of claim 9 further including the step of:

providing a common control function within said common controller which is further subdivided into subfunctions including those for scheduling use of each access point, sequencing of traffic to be transferred via each access point, a data base containing access point idle or busy activity status and facts necessary for other decisions, and message frame composition; and where said scheduling subfunction selectively and sequentially enables each access point in said group to send and receive messages considering the activity status of access points in other groups; and where, for each of said access points, said sequencing function arranges waiting messages by priority and by order-of-arrival into queue, and where said sequencing function determines that the time available for a next transmission is equal or greater than the time required before initiating said next transmission; and where said data base includes data for each access point on the assigned group number and assigned sequence number within that group, and the activity status of that access point.

11. The control method of claim 10 further including the step of:

providing a medium access control transmit function which is common and consecutively connected to each of a plurality of ports which comprise a serially activated group on said common controller.

12. A method for controlling a common channel wireless access premises area communication network, said control method comprising the steps of:

providing a system including a plurality of access points comprising antennae and radio, said access points including alternately used transmit and receive functions, and further including a hub controller connected to and sequentially controlling the transmit function in said access points by multiple electrical conductors;

providing wireless communication services from said access points to a plurality of stations;

providing an access method utilizing a pure binary physical medium wherein all messages are accomplished by coding and content of a digital bit stream;

transmitting asynchronously initiated messages from said access points which include either complete messages to said stations or invitation-to-transmit messages to enable initiation of transmission of messages from said stations when said system is available for message transfer;

organizing said plurality of access points into contiguous groups;

assigning sequence numbers to the access points within a group in a regular pattern; and connecting said groups of access points to said hub controller with one port per access point in which logical functions are executed where a new use of the system is dependent on the idle or busy activity status of the other connected access points.

13. The control method of claim 12 further including the step of:

providing a common control function within said hub controller which is further subdivided into subfunctions including those for scheduling use of each access point, sequencing of traffic to be transferred via each access point, a data base containing access point idle or busy activity status and facts necessary for other decisions, and message frame composition; and where, for each of said access points, said sequencing function arranges waiting messages by priority and by order-of-arrival into queue, and where said sequencing function determines that the time available for a next transmission is equal or greater than the time required before initiating said next transmission; and where said data base includes data for each access point on the assigned group number and assigned sequence number within that group, the idle or busy activity status of that access point; and where said data base also includes a qualitative representation of the signal level for the station with which the access point is communicating.

14. The control method of claim 13 further including the step of:

providing a medium access control transmit function which is common and consecutively connected to each of a plurality of ports which comprise said serially activated group on said hub controller.

* * * * *